US005619827A

United States Patent [19]

Church

[11] Patent Number: 5,619,827

[45] Date of Patent: Apr. 15, 1997

[54] ROOF EDGE FLASHING AND ANCHORING SYSTEM

[76] Inventor: John E. Church, 6305 Babson Way, Virginia Beach, Va. 23464

[21] Appl. No.: 508,457

[22] Filed: Jul. 28, 1995

[51] Int. Cl.[6] ..... E04D 1/36

[52] U.S. Cl. ..... 52/60; 52/94

[58] Field of Search ..... 52/97, 94, 58, 52/60

[56] References Cited

U.S. PATENT DOCUMENTS

| | | | |
|---|---|---|---|
| 4,549,377 | 10/1985 | Castle | 52/94 |
| 4,780,999 | 11/1988 | Webb et al. | 52/60 X |
| 4,848,045 | 7/1989 | Nichols et al. | 52/94 X |
| 5,251,411 | 10/1993 | Kelley et al. | 52/60 |

*Primary Examiner*—Carl D. Friedman
*Assistant Examiner*—Timothy B. Kang

[57] ABSTRACT

A flexible roofing membrane is attached around the perimeter edge of a roof by the interlocking cooperation of a continuous sheet metal cleat member and a continuous sheet metal locking member. The cleat member is secured to roof perimeter blocking by common fasteners which penetrate the cleat member. The loose edge of the roofing membrane is sandwiched between the cleat member and the locking member, which snaps into locking position within a sheltered cavity formed by the cleat member. The cleat-membrane-locking member assembly provides a water-tight flashing system at the roof edge as well as a means for anchoring the membrane to the roof.

10 Claims, 5 Drawing Sheets

*12 AND 22 ASSEMBLY*

12 CLEAT

22 LOCKING PLATE

12 AND 22 ASSEMBLY

LOCKING TOOL 75 (OPEN)

LOCKING TOOL 75 (CLOSED)

ROOF EDGE FLASHING AND ANCHORING SYSTEM

BACKGROUND OF THE INVENTION

1. Field of the Invention

The present invention relates to flashing systems for installation along roof edges to anchor and make the roof edge water-tight. In particular, the present invention relates to roof edge flashing systems for anchoring and making water-tight flexible and membrane roof elements.

2. Description of the Prior Art

Typically, flexible roofing manufacturers have relied on fastening through the flexible roofing in order to anchor the flexible roofing to the roof edge blocking. The gravel stop/edge system manufacturers recommend fastening their flashing systems on top of the flexible roofing in order to assist in anchoring the flexible roofing also attaching their flashing system to the roof edge blocking, preventing the roof from blowing off in stormy/windy conditions. To prevent water leakage through the multiple anchoring fasteners the flexible roofing manufacturers and the gravel stop/edge system manufacturers have recommended "stripping off" or installing a separate strip of flexible roofing (sometimes special flexible roofing) over the roof fastening leg of the flashing extending on top of the flexible roofing 3" to 6", gluing, heat welding, solvent welding, seam tapping and/or caulking are various sealers used to make stripping water-tight to roof and the gravel stop/edge system. The stripping never extends beyond the roof blocking nor below the roof blocking at water runoff locations without penetrating flexible roofing with fasteners.

SUMMARY OF THE INVENTION

Accordingly, it is a primary object of the present invention to provide a method and apparatus for anchoring and making a water-tight enclosure along the roof edge, flexible roofing membranes.

It is another object of the present invention to provide a device of the character described which allows flexible roofing membranes to be installed over its anchoring cleat without requiring the penetration of the flexible roofing membrane.

It is another object of the present invention to provide a device of the character described to which allows flexible roofing membranes to be installed upon roofs without requiring the penetration of the flexible roofing membrane.

It is another object of the present invention to provide a device of the character described which does not require the use of "stripping".

It is another object of the present invention to provide a device of the character described which does not require the use of glues, heat welding, solvent welding, seam tapes, or caulks to anchor or seal the flexible roofing membrane.

It is another object of the present invention to provide a device of the character described wherein the flexible roofing membrane extends beyond and below the roof blocking and water runoff locations without penetrating the flexible roofing membrane.

Further objects and advantages of my invention will become apparent from a consideration of the drawings and ensuing description thereof.

DESCRIPTION OF THE PREFERRED EMBODIMENT

The present invention is a method and apparatus for securing a flexible roofing membrane (generally indicated M in the figures) along the perimeter edge(s) of a roof without necessitating or occasioning puncture, penetration or injury of the membrane. The invention comprises a two part flashing system consisting of a first flashing member. "cleat" (generally designated 12 in the figures) and a second flashing member "locking plate" (generally designated 22 in the figures).

Figure 1:
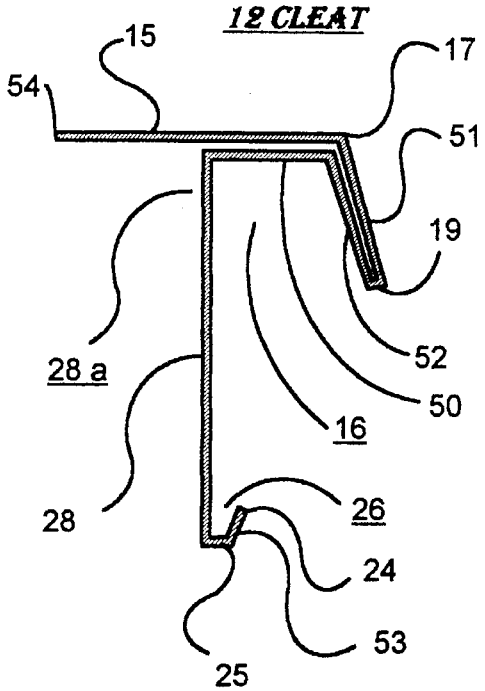
FIG. 1 is a side view of the cleat member of the present invention.

Referring now to FIG. 1:

The cleat 12 comprises a generally horizontally oriented first portion ("roof fasteningly") 15, which extends from an upper lip 54 to a first friction point 17, and a sixth portion ("outwardly inclined section") 51 which extends between the first friction point 17 and a second friction point 19. From the second friction point 19 the cleat bends inwardly, and a third portion ("interior inclined section") 52 of the cleat 12 extends, adjacent to and parallel to the outwardly inclined section 51, from the second friction point 19 to a fifth portion ("intermediate horizontal section") 50. The intermediate horizontal section 50 runs substantially parallel to and adjacent to the underside of the roof fastening leg 15 of the cleat. A second portion ("vertical fastening leg") 28 of the cleat extends downwardly from the intermediate horizontal section 50 of the cleat. The length of the intermediate horizontal section 50 of the cleat is preferably shorter than the roof fastening leg 15 of the cleat, such that the roof fastening leg 15 extends beyond the inboard side **28*a* of the vertical fastening leg 28, as shown in the figures. The interior inclined section 52, the intermediate horizontal section 50 and the vertical fastening leg 28 together partially enclose an upper cavity 16. The vertical fastening leg 28 of the cleat extends downward to an upward bend 25. A a fourth portion ("upwardly inclined section") 53 of the cleat extends from the upward bend 25 to a lower lip 24. The bottom portion of the vertical fastening leg 28, the upward bend 25 and the upwardly inclined section 53 of the cleat partially enclose a lower cavity 26**.

The cleat 12 is preferably constructed of a continuous (i.e. from the upper lip 54 to the lower lip 24) metal of relatively thin thickness. The cleat 12 may be constructed, for example, of copper, tin, aluminum, or galvanized sheet metal, or of other commonly used roof flashing materials.

Figure 2:
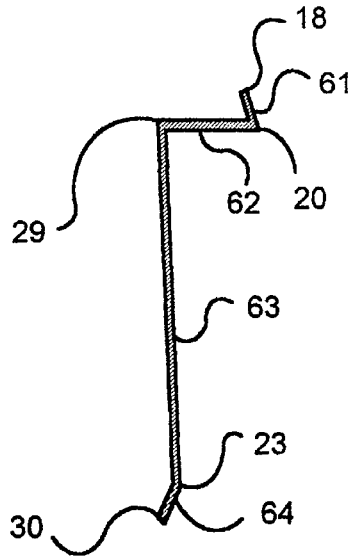
FIG. 2 is a side view of the locking plate member of the present invention.

Referring now to FIG. 2:

The locking plate 22 is preferably constructed of a continuous metal sheet in the configuration shown in the figures. A first portion ("upper inclined section") 61 of the locking plate 22 extends from an upper locking lip 18 to a first bend 20. A second portion ("intermediate horizontal section") 62 of the locking plate 22 extends from the first bend 20 to the friction point 29. The friction point 29 is essentially a right angle bend in the locking plate 22. A third portion ("intermediate vertical section") 63 of the locking plate 22 extends from the friction point 29 downwardly to an inward bend 23 near the bottom of the locking plate 22. A fourth portion ("lower inclined section") 64 of the locking plate extends from the inward bend 23 to the lower locking lip 30 at the bottom edge of the locking plate 22.

Figure 3:
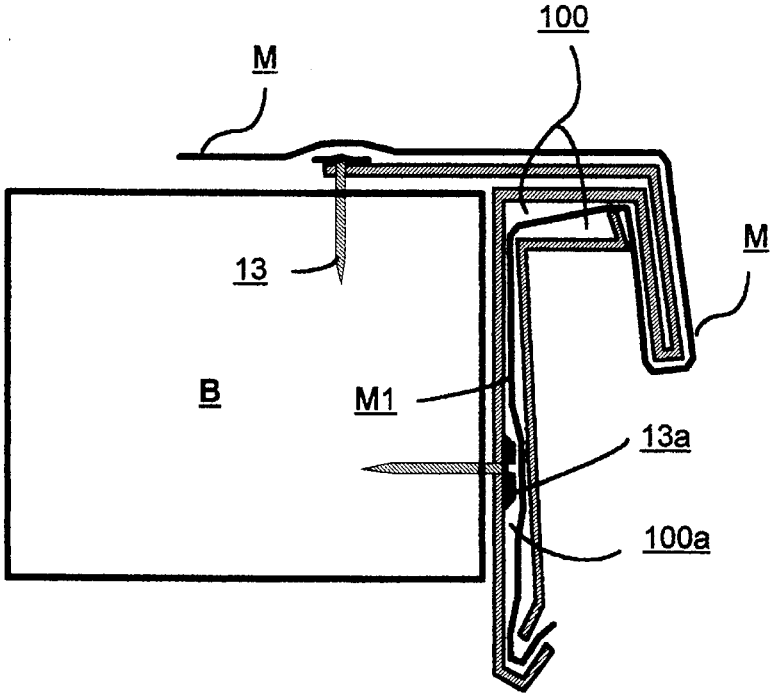
FIG. 3 is a side view showing the cleat and locking plate assembly of the present invention securing a flexible roofing membrane to an edge of a roof.

Referring now to FIG. 3:

The cleat 12 and the locking plate 22 are used in conjunction with each other in such a way as to secure a free edge of a flexible roofing membrane (generally designated M in the drawings) to the perimeter edge of a roof. Typical membrane roof construction comprises blocking B around the perimeter of the roof. In order to secure the flexible roofing membrane M to the roof, fasteners 13 (such as a nails) are used to attach the roof fastening leg 15 and the vertical fastening leg 28 of the cleat 12 to the blocking B. The flexible roofing membrane M is then drawn over the exposed surfaces of the cleat, (including the top of the roof fastening leg 15, the outwardly inclined section 51, the interior inclined section 52, the vertical fastening leg, the upwardly inclined section 53, and the lower lip 24), as shown in FIG. 3. The locking plate 22 is then installed as shown in FIG. 3 such that a portion Ml of the membrane is sandwiched between the locking plate 22 and the cleat 12. Once installed, the intermediate horizontal section 62 of the locking plate 22 is locked in place inside of the upper cavity 16 of the cleat, and the lower inclined section 64 of the locking plate 22 is locked inside of the lower cavity 26 of the cleat 22. With the locking plate 22 locked in place as described, the membrane M will be secured in place by friction between the cleat 12 and the membrane M and the locking plate 22, particularly at the points of contact of the locking plate 22 and the membrane M at the upper locking lip 18, the friction point 29, and the lower locking lip 30 of the locking plate.

In the preferred embodiment of the invention, the roof fastening leg 15 of the cleat 12 extends a sufficient distance inboard of the vertical fastening leg 28, (perhaps 2 to 3 inches), to accommodate various types of fasteners 13 by which the cleat may be secured to the blocking B. In the preferred embodiment of the invention fasteners 13 are roofing nails, but any common fastening member could be similarly used. Fasteners 13 are preferably spaced approximately 6" on center along the roof fastening leg 15 of the cleat 12.

The vertical fastening leg 28 of the cleat 12 is similarly secured to the blocking B with fasteners 13, approximately 12 inches on center. The inward bend 23 between the lower inclined section 64 and the intermediate vertical section 63 of the locking plate provides concealed fastener head room 100*a* (i.e. a narrow cavity), between the intermediate vertical section 63 of the locking plate and the vertical fastening leg 28 of the cleat, to accommodate the fastener heads 13*a*.

OPERATION

FIGS. 4–9 sequentially show how a roof edge flashing and anchoring assembly constructed in accordance with the present invention may be installed on a roof.

Figure 4:
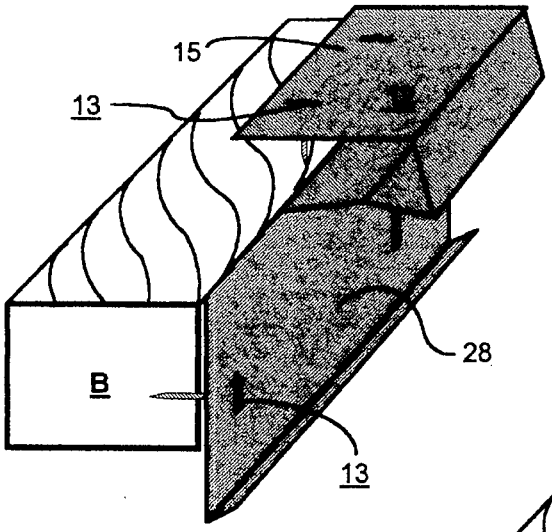
FIGS. 4–9 are perspective views showing sequential steps of the process present invention.

Referring to FIG. 4:

The cleat 12 is first attached to the roof blocking B with nail fasteners 13 which penetrate the roof fastening leg 15 of the cleat, and with nail fasteners 13 which penetrate the vertical fastening leg 28 of the cleat.

Figure 5:
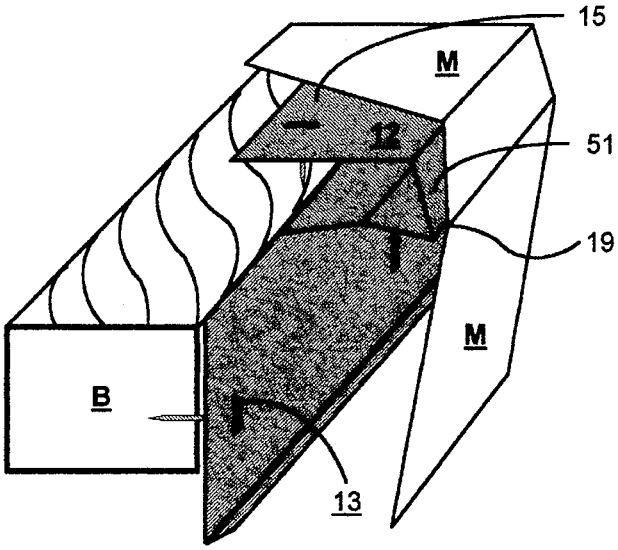

Referring to FIG. 5.

The membrane M, which typically would extend continuously between opposite edges of the roof, is drawn over the roof fastening leg 15 and the outwardly inclined section 51 of the cleat, with approximately 4 to 5 inches of the membrane M extending beyond the second friction point 19, as shown in FIG. 5.

Figure 6:
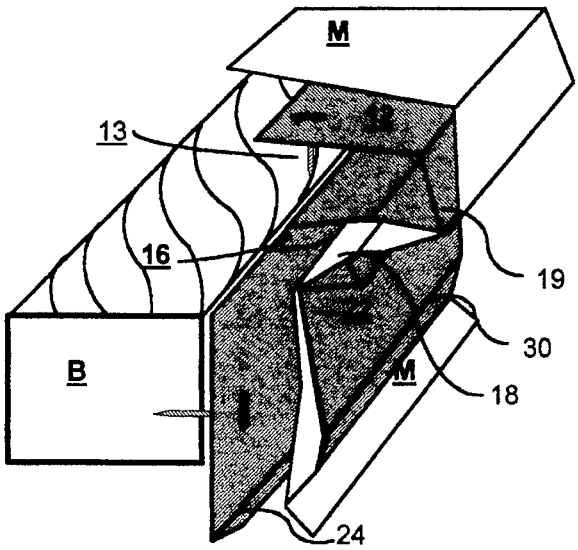
Figure 7:
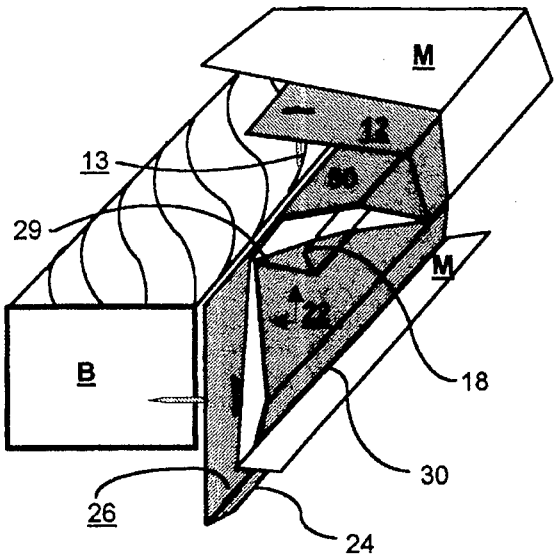
Figure 8:
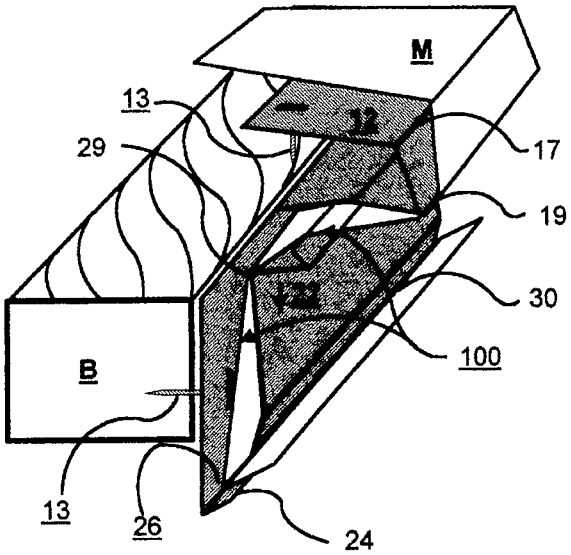

Using the upper locking lip 18, the membrane M is forced down beyond the cleat's second friction point 19 (as shown in FIG. 6), then inward and upward into the upper cavity 16, and the locking plate 22 is elevated vertically into the cavity 16 until the lower locking lip 30 of the locking plate is elevated above the lower lip 24 of the cleat 12 (as shown in FIG. 7), thus engaging the upper locking lip 18 and the friction point 29 of the locking plate with the cleat.

Figure 9:
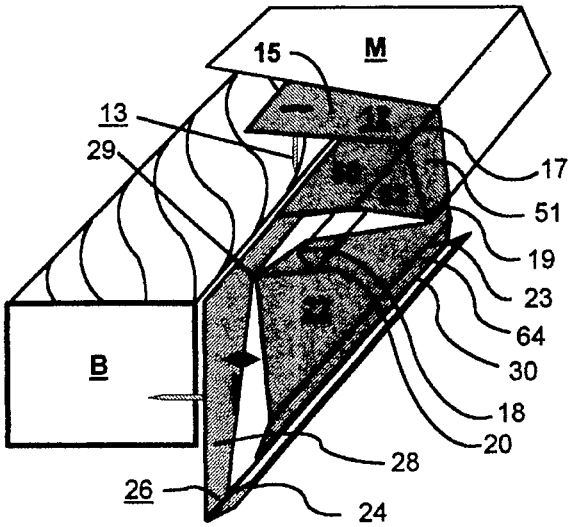
Figure 10:
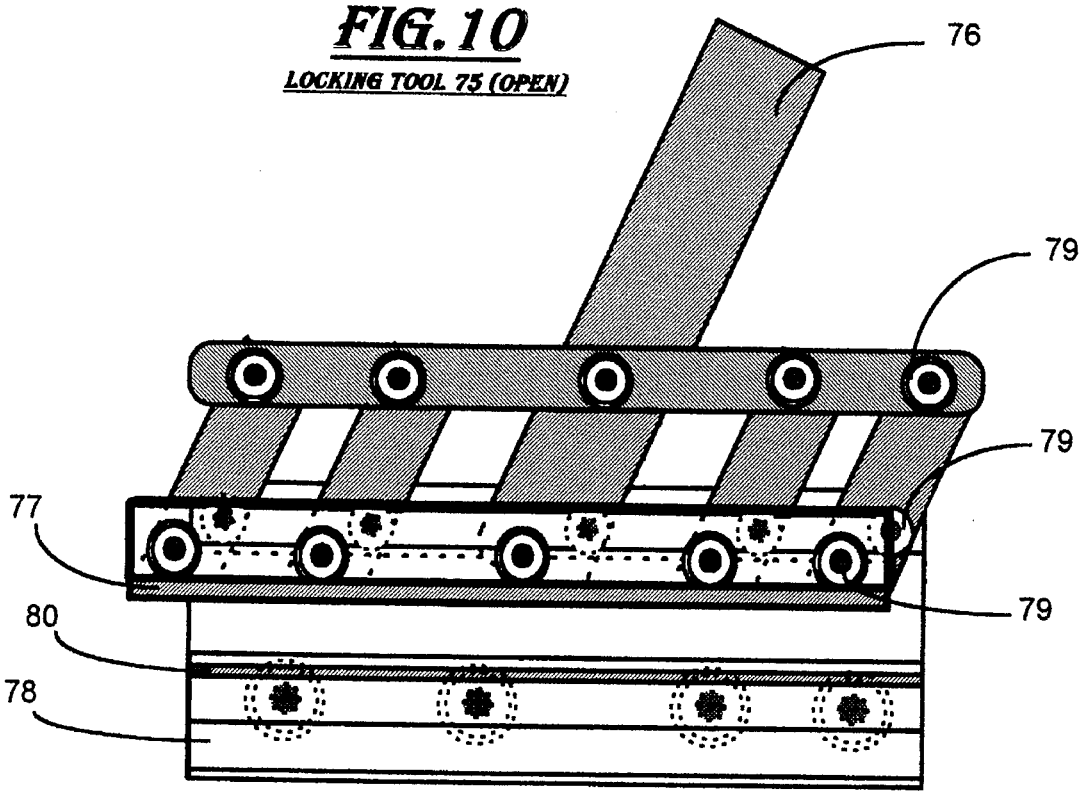
FIG. 10 is a side view in partial cross-section showing the locking tool used in the installation of the present invention, in operation in the open position.
Figure 11:
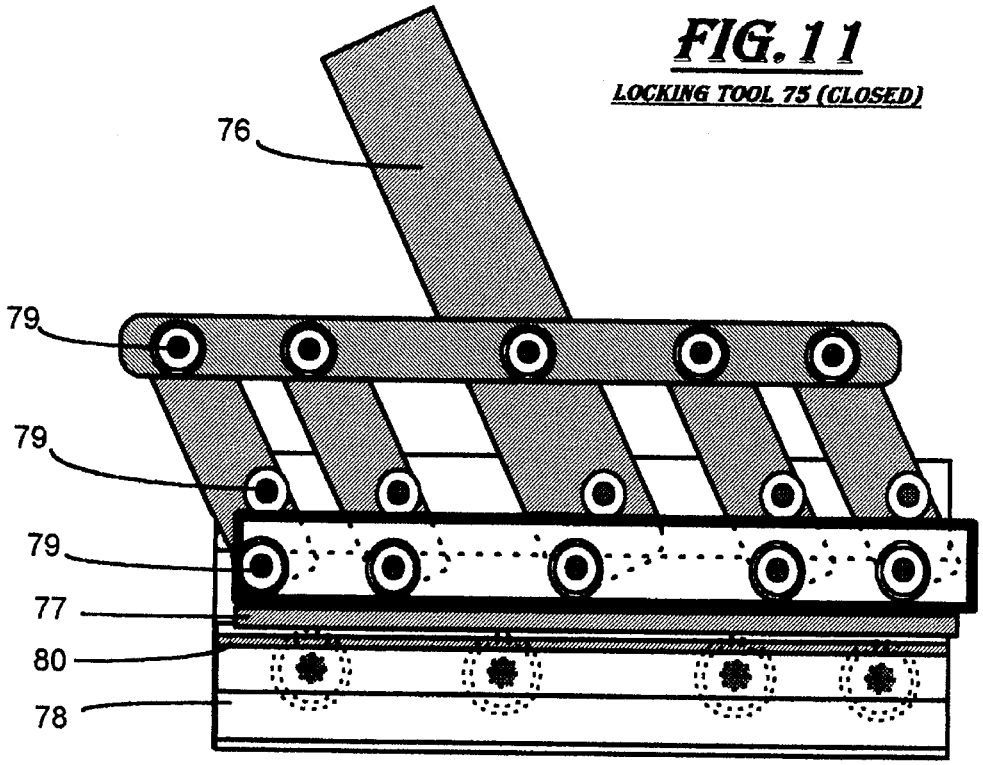
FIG. 11 is a side view in partial cross-section showing the locking tool used in the installation of the present invention, in operation in the closed position.
Figure 12:
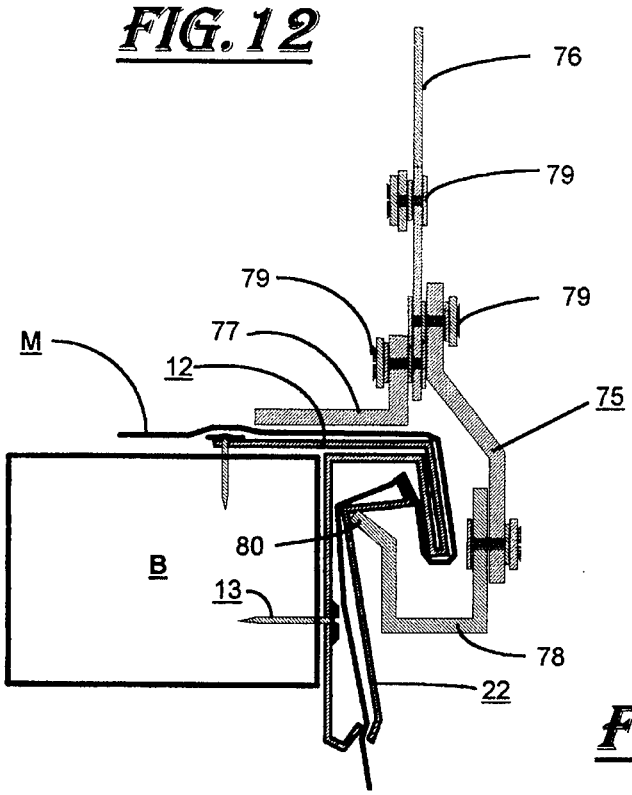
FIG. 12 is a front view showing the locking tool in the open position.
Figure 13:
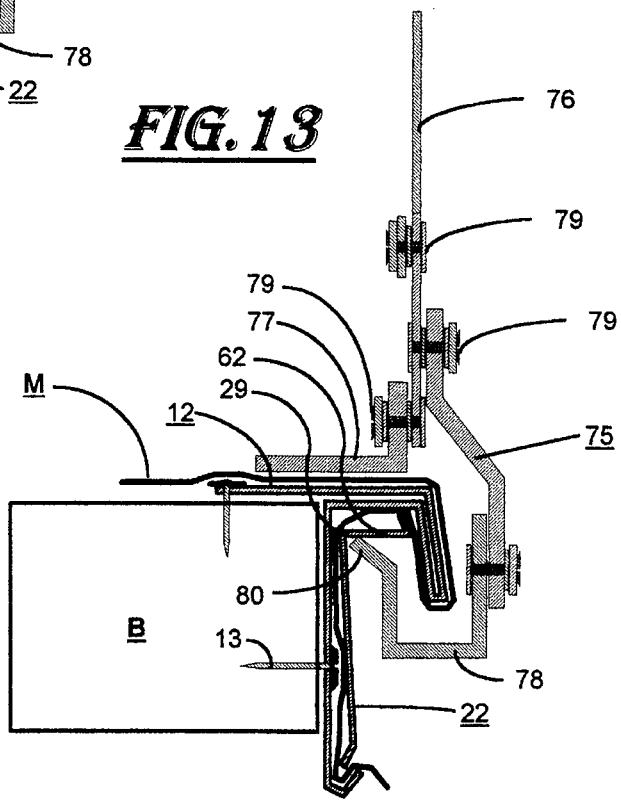
FIG. 13 is a front view showing the locking tool in the closed position.

The locking plate 22 is preferably constructed of sufficiently resilient and elastic material that it may be manually deformed from a neutral configuration (i.e. so as to fit between the lower lip 24 and the intermediate horizontal section 50 of the cleat), and, upon its release from manual deformation, spring back to or nearly to its neutral shape. After the upper portion of the locking plate 22 has been elevated into the upper cavity 16 and sufficiently manually compressed/deformed to allow the lower locking lip 30 of the locking plate to be above the lower lip 24 of the cleat 12, the locking plate 22 may then be manually released, allowing the locking plate 22 to spring back to (or nearly to) its neutral configuration, thus locking (i.e. pinching) the membrane M between the cleat 12 and the locking plate 22 in the vicinity of the upper locking lip 18 the friction point 29 and the lower locking lip 30 of the locking plate, as shown in FIG. 9 and 3.

Excess membrane M material extending out of the lower cavity 26 may be trimmed off at the lower lip 24 of the cleat.

It will be understood from the foregoing that when the locking plate 22 and the cleat 12 are assembled together in the manner described, a membrane passageway 100 is formed between the cleat 12 and the locking plate 22 which is adapted to receive the flexible roofing membrane M. Furthermore, it will be understood that the passageway 100 is continuous from the top to the bottom (i.e. from the upper locking lip 18 to the lower locking lip 30) the locking plate.

It will be understood that a roof edge flashing and anchoring assembly constructed in accordance with the foregoing disclosure provides a means for securing flexible roofing membrane M to the perimeter of a roof, without necessitating the use of membrane-penetrating fasteners.

It will also be understood that a roof edge flashing and anchoring assembly constructed in accordance with the foregoing disclosure provides a means for rendering the perimeter of the roof water-tight.

The described roof edge flashing and anchoring system relies upon the spring tension of the locking plate 22, acting against the cleat 12, to properly secure the flexible roofing membrane M in place. As discussed above, during the installation of the present invention it is necessary to temporarily deform (i.e. compress) the locking plate 22 so as to permit it to fit between the lower lip 24 and the underside of the intermediate horizontal section 50 of cleat 12. In order to facilitate the installation of the locking plate 22, an installation tool may be used. One embodiment of such an installation tool (generally designated 75 in the drawings) is illustrated in FIGS. 10–13.

The installation tool 75 generally comprises a handle 76 which is pivotally connected to an upper jaw 77 and a lower jaw 78 by hinge pins 79, as Shown in the figures. In operation, the upper jaw 77 is generally horizontally oriented so as to conform with and apply a downward pressure to the flexible roofing membrane M on the horizontal floor fastening leg 15 of the cleat 12. The lower jaw 78 is U-shaped and has a generally upwardly directed lip 80 which is adapted to apply a upward pressure against the lower side of the intermediate horizontal section 62 of the locking plate 22 in the vicinity of the locking plate's friction point 29. The upper and lower jaws (77 and 78, respectively) may be selectively drawn together or moved apart by manually operating the handle 76. Because the upwardly directed lip 80 may be positioned against the lower side of the intermediate horizontal section 62 of the locking plate 22 in the vicinity of the locking plate's friction point 29, when the handle 76 is operated so as to cause the upper and lower jaws (77 and 78) to draw together, the upwardly directed lip 80 of the lower jaw will tend to cause the locking plate 22 to deform either at its first bend 20 or at its friction point 29 (or in both areas). This temporary deformation allows the overall dimension from the upper locking lip 18 to the lower locking lip 30 of the locking plate 22 to sufficiently compress to allow the locking plate 22 to fit between the upper and lower cavities (16 and 26, respectively). When the handle 76 is manually moved in the opposite direction, the jaws (77 and 78) with separate, thereby allowing the locking plate to spring back to (or nearly to) its neutral configuration, thus becoming engaged with and locked in place with the cleat 12.

In the preferred embodiment of the invention, both the cleat 12 and the locking plate 22 are continuous elongated members which extend along the roof edge in the manner described to secure a continuous flexible roofing membrane in place, as well as to form a water-tight enclosure.

While the above description contains many specificities, these should not be construed as limitations on the scope of the invention, but rather as an exemplification of one preferred embodiment thereof. Many other variations are possible, for example:

Cleat 12 may be constructed from materials other than metal;

Cleat 12 may be constructed of bent sheet material as described, or may alternatively be fabricated as an extrusion, in which case the outwardly inclined section 51 and the interior inclined section 52 of the cleat 12 may comprise a single member, and the roof fastening leg 15 and the intermediate horizontal section 50 of the cleat may comprise a single member;

Locking plate 22 may be constructed from materials other than metal;

Locking plate 22 may be constructed of bent sheet material as described, or may alternatively be fabricated as an extrusion;

And, the cleat 22 may be modified so as to be attachable to structures other than the top surface of horizontal blocking, and in particular the cleat may be modified so as to be attachable to vertical structures including walls.

Accordingly, the scope of the invention should be determined not by the embodiment illustrated, but by the appended claims and their legal equivalents.

I claim:

1. A system for securing a continuous membrane (M) to a roof edge (B), said roof edge having a top surface and a side surface, said side surface being at an elevation below said top surface, comprising:

a first flashing member (12) extending between a first flashing edge (54) and a second flashing edge (24);

said first flashing member having a first portion (15) extending from said first flashing edge (54) and adapted to be attached said top surface of said roof edge;

and said first flashing member having a second portion (28) below said first portion adapted to be attached to said side surface of said roof edge; a second flashing member (22) extending between a flashing upper edge (18) and a flashing lower edge (30);

said second flashing member having a first portion (61) adjacent said flashing upper edge, and a second portion (62) contiguous with said second flashing member first portion, wherein said second flashing member first portion is oriented at an angle relative to said second flashing member second portion;

said second flashing member further having a third portion (63) intermediately disposed between said second flashing member second portion and said flashing lower edge;

and said second flashing member further having a fourth portion (64) extending from said second flashing member third portion to said flashing lower edge;

and said first flashing member further having a third portion (52), intermediately disposed between said first flashing member first portion and said first flashing member second portion,;

and said first flashing member further having a fourth portion (53), intermediately disposed between said first flashing member second portion and said flashing second edge, and wherein said first flashing member second portion and said first flashing member fourth portion partially form an upwardly opening second cavity (26) adapted to receive said second flashing member fourth portion and said flashing lower edge;

and further comprising an opening (100) between said first flashing member and said second flashing member, said opening being continuous between said second flashing member upper edge and said second flashing member lower edge, and said opening being adapted to receive a membrane disposed between said first flashing member and said second flashing member and extending between said second flashing member upper edge and said second flashing member lower edge;

said first flashing member further having a fifth portion (50) intermediately disposed between said first flashing member third portion and said first flashing member second portion;

and wherein said first flashing member second portion, said first flashing member third portion and said first flashing member fifth portion form a downwardly opening first cavity (16) adapted to receive said second flashing member first portion and said second flashing member second portion;

said first flashing member further having a sixth portion (51) intermediately disposed between said first flashing member first portion and said first flashing member third portion; said first flashing member further having a first bend (19) between said first flashing member sixth portion and said first flashing member third portion, and wherein said first bend is positioned at an elevation below said first flashing member first portion and said first bend is positioned at an elevation below said first flashing member fifth portion.

2. The system according to claim 1, wherein said first flashing member further comprises a substantially horizontal second bend (25) disposed between said first flashing member second portion and said first flashing member fourth portion;

and wherein said first flashing member fourth portion extends upwardly from said second bend;

and wherein said first flashing member second portion is operationally positionable adjacent said side surface of said roof edge between said second flashing member third portion and said side surface of said roof edge.

3. The system according to claim 2 wherein:

a first distance measurable in a straight line from said first flashing member second edge to said first flashing member fifth portion is less than a second distance measurable in a straight line from said second flashing member upper edge to said second flashing member lower edge;

and wherein said second flashing member further comprises a substantially horizontal third bend (20) disposed between said second flashing member first portion and said second flashing member second portion;

and wherein said second flashing member further comprises a substantially horizontal fourth bend (29) disposed between said second flashing member second portion and said second flashing member third portion;

and wherein said second flashing member first portion extends upwardly from said third bend.

4. The system according to claim 3 further comprising:

a first fastener member (13) for attaching said first portion of said first flashing member to said top surface of said roof edge.

5. The system according to claim 4 further comprising:

a second fastener member (13) for attaching said second portion of said first flashing member to said side surface of said roof edge.

6. The system according to claim 5 wherein said second flashing member is constructed of a resilient material.

7. The system according to claim 6 wherein said first fastener member being capable of penetrating said first flashing member first portion.

8. The system according to claim 7, further comprising a continuous membrane, said membrane being capable of extending from said top surface of said roof edge, over top of said first flashing member first portion and said first flashing member sixth portion, thence between said first flashing member fifth portion and said second flashing member second portion, and thence downwardly between said first flashing member second portion and said second flashing member third portion;

wherein said second fastener member being capable of penetrating said first flashing member second portion.

9. The system according to claim 8 wherein said first flashing member first portion is adopted to be oriented in a substantially horizontal plane and wherein said first flashing member second portion is oriented in a substantially vertical plane.

10. The system according to claim 9 wherein:

said second bend in said first flashing member is at an elevation below said lower edge of said second flashing member.

* * * * *